US006549631B1

(12) United States Patent
Jackson

(10) Patent No.: US 6,549,631 B1
(45) Date of Patent: Apr. 15, 2003

(54) PRESSURE TRANSDUCING ASSEMBLY

(75) Inventor: Said Gregor Jackson, Los Gatos, CA (US)

(73) Assignee: Sony International (Europe) GmbH, Berlin (DE)

( * ) Notice: Subject to any disclaimer, the term of this patent is extended or adjusted under 35 U.S.C. 154(b) by 224 days.

(21) Appl. No.: 09/588,915

(22) Filed: Jun. 7, 2000

(30) Foreign Application Priority Data

Jun. 9, 1999 (EP) ..... 99111245

(51) Int. Cl.[7] ..... H04R 3/00; H04R 25/00

(52) U.S. Cl. ..... 381/111; 381/191; 381/192; 381/172; 381/173; 381/174; 381/151

(58) Field of Search ..... 381/111–115, 172–174, 381/191–192, 151

(56) References Cited

U.S. PATENT DOCUMENTS 4,422,182 A * 12/1983 Kenjyo ..... 359/150
5,203,335 A * 4/1993 Noujaim et al. ..... 600/447
6,285,769 B1 * 9/2001 Edelson et al. ..... 381/111

* cited by examiner

*Primary Examiner*—Minsun Oh Harvey
*Assistant Examiner*—Laura A. Grier
(74) *Attorney, Agent, or Firm*—Frommer Lawrence & Haug LLP; William S. Frommer

(57) ABSTRACT

A pressure tranducing assembly for converting received pressure into a digital pressure signal. A pressure transmitter adapted to receive a first mechanical pressure from an environment and to transmit that pressure to a pressure processor. The pressure processor is adapted to generate the second or internal mechanical pressure therein in accordance with the first pressure. The pressure processor comprises a pressure signal generator to generate a first analogue pressure signal representative of the second pressure. A pressure compensator within the pressure processor is adapted to receive an analogue pressure compensation signal and to generate an additional pressure to compensate the second pressure at least in part. A pressure signal processor processes the first analogue pressure signal and has negative-feedback capabilities to generate the analogue pressure compensation signal and to generate a digital pressure signal that is representative of at least the second internal pressure as an output signal.

22 Claims, 5 Drawing Sheets

PRESSURE TRANSDUCING ASSEMBLY

DESCRIPTION

Figure 1:
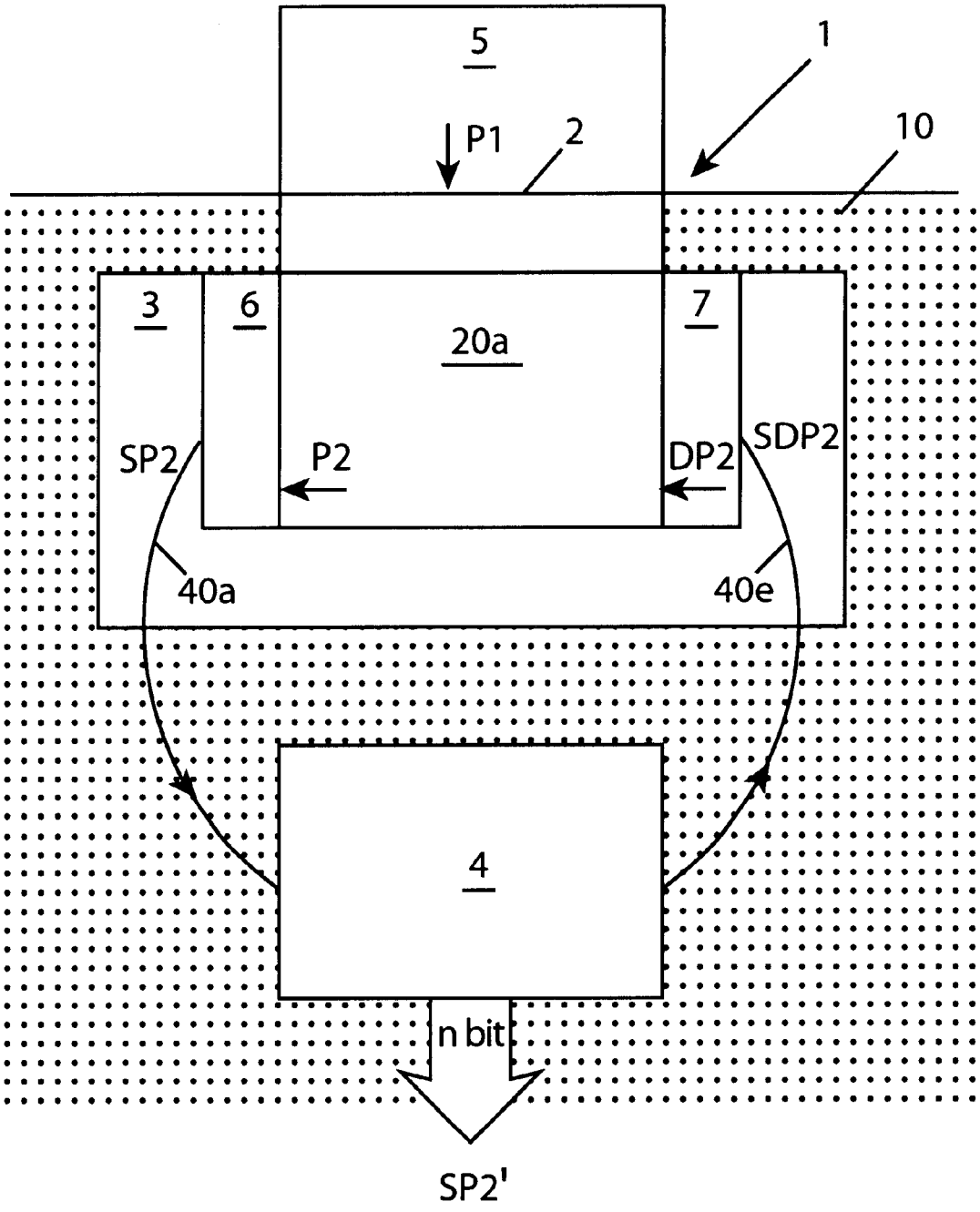

The present invention relates to a pressure transducing assembly according to the preamble of claim 1.

It is known in the art that having measurement data in digital form offers the advantage over the well-known analogue representation of data to show very low additional signal noise and distortions in particular during the steps of further processing.

Picking-up measurement data from pressure measurements, for example in the infrasonic, ultrasonic or audible range, using conventional pressure transducing assemblies or digital microphones leads to signal distortions and noise impacts which are—in accordance with the tremendous low noise level capabilities of present data/sound playback devices—in some cases disturbing.

Therefore, digital pressure pick-up devices/microphones have been developed with the aim to generate a digital equivalent of the analogue pressure-/sound signal at a very early stage of the signal processing chain.

In the known art digital pressure pick-up devices or microphones comprise an audio or pressure transducer on the basis of an analogue pressure/audio signal conversion process. These audio/pressure transducers of the conventional art contain at a first stage a transducer section which converts the mechanical analogue pressure value into an analogue electrical equivalent.

A microphone/pressure transducer generally produces a low-level electrical signal in response to that audible sound/pressure levels around the microphone/pressure transducer. This particular low-level electrical signal is then transmitted or conducted along an electrical pathway or cable to subsequent processing apparatuses—for example, a digital signal processing device such as an audio mixing and control section—where it is converted into a digital signal for further processing.

Along the particular electrical pathway the low-level electrical signal is affected by external noise and interference processes during transmission along the cable. Further, analogue amplification—usually in the range of 40–60 db—introduces noise and distortions.

Therefore, known digital microphones/pressure transducing assemblies utilize an analogue amplification stage immediately after the mechanical-to-electrical conversion of the sound/pressure so as to increase the signal-to-noise ratio.

Immediately after amplification an analogue-to-digital converter is connected which produces a digital equivalent to the analogue and amplified measuring signal.

Although known devices for modulating or converting analogue electrical signals do not produce further analogue noise per se, conventional electric negative feedback loops, for example in 1-bit analogue/digital converters, interact with further analogue equipment and in particular with difference/summation amplifiers which do introduce additional analogue noise to the sound/pressure signal in the feedback process, e.g. of a conventional delta-sigma modulator or transducer. Analogue amplification by itself is much worse than A/D conversion noise.

It is therefore an object of the present invention to improve the signal-to-noise ratio performance of known sound/pressure transducing assemblies.

This particular object is achieved with a pressure transducing assembly according to the generic part of claim 1 with the characterizing features of claim 1.

It is a further object of the present invention to reduce the parts count and assembly cost and size of sound/pressure transducing assemblies. Advantageous embodiments of the inventive transducing assembly are covered by the dependent claims.

State of the art pressure transducing assemblies for converting a received pressure into a digital pressure signal in general comprise pressure transmitting means, pressure receiving processing means and pressure signal processing means.

In accordance with the present invention the pressure transmitting means is adapted to receive a first or environmental mechanical pressure from an environment and to transmit said first pressure to said pressure receiving and processing means. Said pressure receiving and processing means is adapted to generate a second or internal mechanical pressure therein in accordance with said received first pressure and further to process said second pressure. Said pressure receiving and processing means comprises pressure signal generating means which is adapted to generate a first or analogue pressure signal being representative for said second pressure. Additionally, said pressure receiving and processing means has pressure compensating means to receive a pressure compensation signal and to generate an additional pressure within said pressure receiving and processing means in particular according to said analogue pressure compensation signal as to compensate said second pressure at least in part. The pressure signal processing means is adapted to receive and process said first analogue pressure signal. Furthermore, said pressure signal processing means has negative feedback capabilities to generate said analogue pressure compensation signal at least based on said received analogue pressure signal. Finally, said pressure signal processing means is adapted to generate a digital pressure signal having an integer number of bits and being representative at least for said internal pressure and/or said first or environmental pressure and to provide at least said digital pressure signal as an output signal.

A basic idea of the present invention is to exchange noise introducing analogue electronic elements of conventional sound/pressure transducing assemblies, in particular the analogue input amplifier together with the difference/summation-amplifier of negative-feedback capability, by means of mechanical components.

Therefore, the inventive pressure transducing assembly does not contain a mechanical-to-electrical signal transducer in connection with the amplifier and difference amplifier as an input stage. Instead, a received pressure signal from an environment is transmitted to pressure processing means, which indeed further processes the pressure, i. e. the physical or mechanical entity itself instead of its electrical equivalent as done by the conventional art.

The pressure processing means comprises a pressure signal generating means, which converts the pressure/sound—being processed—into an equivalent analogue electrical signal.

The equivalent electrical signal is then further processed in conventional manner by pressure signal processing means. Such a pressure signal processing means utilizes an integrator and a comparator to produce a digitized equivalent of the analogue electrical pressure signal. According to the negative-feedback capability of the pressure signal processing means the digital signal is fed back to the mechanical acting pressure receiving and processing means by using a digital-to-analogue converter which re-converts an integrated and digitized pressure signal into an analogue pressure compensation signal, the latter being impressed to the provided pressure compensating means of said pressure receiving and processing means. In particular 1-bit—i. e. on or off—or multi-bit digital-to-analogue conversion is applied.

The pressure compensating means then produces an additional pressure within said pressure receiving and processing means so as to compensate the pressure in said pressure receiving and processing means at least in part. Therefore, a mechanical realization of a negative-feedback control loop is realized by exchanging a conventional electrical amplifying and comparing stage by means of mechanical analogues. Therefore, no additional analogue electrical noise is introduced and accordingly, the output signal of the pressure signal processing means can have a better signal-to-noise ratio compared with the purely electrical or electronical realizations of sound/pressure transducing devices.

These conventional sound/pressure transducing devices are often known as delta-sigma transducers or modulators, and they are also called balanced charge transducers or modulators as they perform in part an electrical compensation of the analogue electrical input signal, thereby introducing additional noise on the electronic feedback signal.

Instead, the present invention therefore realizes a delta-sigma direct digital transducer which may be also called balanced pressure transducer or modulator, as it balances and compensates the pressure to be received and converted.

A preferred embodiment the inventive pressure transducing assembly comprises housing means into which at least said pressure transmitting means and said pressure receiving and processing means are assembled or embedded.

This ensures that the pressure transmitting means and the pressure receiving and processing means are fixed rigidly. Furthermore, the pressure receiving and processing means is protected against unwanted interactions, as pressure or material flow bypasses are avoided.

It is for instance possible to manufacture the inventive pressure/sound transducing assembly onto a single piece of a silicon chip, in particular using VLSI mikro-/nanotechnology.

In the following the notation "pressure" is used. This notation is understood to include a pressure-distribution varying in time and space. Therefore, the notation "pressure" also includes "sound" being in the infrasonic, ultrasonic or audible range.

According to a further advantageous embodiment the pressure transmitting means of said inventive pressure transducing device has a first section being exposed to the environment and/or therefore to the first pressure to be received and converted. Furthermore, said pressure transmitting means has a second section being exposed to said pressure receiving and processing means. Therefore, the pressure transmitting means may be understood as a separating interface between the environment on the outside of said assembly and the pressure receiving and processing means inside the inventive assembly embedded in and protected by the housing means.

To protect said pressure receiving and processing means from being affected by pressure and/or material flow bypasses, said pressure transmitting means and/or said housing means are adapted and arranged so as to essentially isolate the pressure receiving and processing means from being directly affected by pressure and/or material flow from the environment. This ensures the avoidance of mechanical short circuiting.

The protecting effect is increased by having said housing means essentially mechanical rigid and/or impermeable to material exchange.

Furthermore, said pressure transmitting means is essentially impermeable to material exchange according to a preferred embodiment of the present invention.

Said pressure transmitting means may have at least a first membrane element with an environmental side face which is exposed to the environment and an inside face being exposed to said pressure receiving and processing means. Said membrane element is according to a preferred embodiment of the invention mechanical flexible so as to be capable to transmit the environmental pressure from said environmental side face of said membrane element to said internal side face. Therefore, said membrane element is arranged in said housing means so as to separate said pressure receiving and processing means from direct pressure and/or material flow from said environment.

The mechanical interaction and therefore the realization of a mechanical negative-feedback loop is obtained by having a cavity assembly arranged in said housing means as a part of said pressure receiving and processing means. Said pressure transmitting means is at least a part of a boundary of said cavity assembly against the environment.

According to another advantageous embodiment of the present inventive pressure transducing assembly said pressure signal generating means comprises at least a first separating element which is arranged to form an isolated detection compartment within said cavity assembly. Said detection compartment is isolated from said environment as well as from said transmitting means and has an outside face which is exposed to a remaining compartment of the cavity assembly, which itself has said pressure transmitting means as a part of its boundary—and an opposed inside face which is exposed to the inside of the detection compartment.

According to that arrangement the cavity assembly is subdivided into a detection compartment which has as its only boundaries the housing and the pressure signal generating means. There is no direct connection to the remaining cavity assembly to the pressure transmitting means or to the environment.

On the other hand, there is formed another compartment within the cavity assembly being separated from the detection compartment which is called compensation compartment.

Therefore, the pressure compensating means comprises at least a second separating element which subdivides an isolated compensation compartment within said cavity assembly. Said compensation compartment is isolated from said environment as well as from said pressure transmitting means. It comprises an outside face that is exposed to a remaining compartment of the cavity assembly—which itself contains a pressure transmitting means as a part of its boundary—and comprises an opposed inside face being exposed to the inside of the compensation compartment.

Therefore, the compensation compartment has the same properties as the detection compartment and furthermore the detection compartment and the compensation compartment do not have an intersecting part. They do not have a common boundary. Said first and/or second separating element comprises at least a mechanical flexible membrane to allow for best mechanical interaction between the separating compartment of the cavity assembly.

In particular, a first and/or second membrane has at least in part an electrical conductive surface. Therefore, first and/or second membrane may act as a condenser or capacitor.

In the case that the first membrane is incorporated into said pressure signal generating means, according to the internal pressure of the pressure receiving and processing means the first membrane bends or vibrates so that the membrane's shape is changed. This shape change leads to a change in the charge distribution, the electrical field distribution and/or the electrical voltage generated by said first membrane acting as a capacitor. The change of the electrical and/or mechanical properties of the first membrane may be detected and may serve as an analogue pressure signal for the internal pressure of the pressure receiving and processing means.

When said membrane incorporated into said pressure compensating means is electrical conductive and acts as a capacitor, the electrical charge distribution, electrical field and/or voltage on the capacitor may be altered in accordance with said pressure compensating signal. In accordance to the alteration of the electrical properties of the second membrane of the pressure compensating means, the membrane bends and alters its mechanical shape which leads to a change of the internal pressure of the pressure receiving and processing means in accordance with the compression or expansion of the medium inside.

Of course, the second membrane's mechanical shape may be altered directly to produce a change in the internal pressure.

Said first and/or second membrane may contain at least in part electrostrictive and/or piezoactive material. It is also possible to use resistors embedded into said first sensing membrane. Mechanical stressers change the resistance of the embedded resistor and the change in the resistance may be measured and may serve as a measure for the pressure state of the cavity of pressure receiving and processing means. On the other hand a resistor may be also embedded in said second actuating or compensating membrane. By heating the resistor embedded in said second membrane—for instance by applying an electrical current to said resistor—the membrane might expand and thus change its mechanical state. Therefore, said second membrane acts as an actuator.

Therefore, by changing the shape, i. e. curvature, effective surface or the like, said first membrane produces according to the electrostrictive/piezoactive properties of the material incorporated a change in the electrical state which can be detected directly as a measure for the pressure variation of the internal pressure of the pressure receiving and processing means.

On the other hand, changing the electrical properties of the said second membrane of the pressure compensating means leads—also due to the electrostrictive/piezoactive properties of the material incorporated—to a shape change of the second membrane and therefore to an alteration of the internal pressure in the pressure receiving and processing means.

According to a further preferred embodiment of the inventive assembly for transducing pressure said pressure signal generating means comprises sensor means being adapted to sense the electrical and/or mechanical state of said first membrane and to provide said analogue pressure signal being representative for said internal pressure of said pressure receiving and processing means.

Pressure compensating means may comprise probe and/or actuator means being adapted to change the electrical and/or mechanical state of the second membrane, respectively, according to said direct pressure compensating signal so as to force said second membrane to superpose said additional pressure to the remaining compartment of said cavity assembly.

According to a preferred embodiment of the inventive pressure transducing assembly pressure receiving and processing means and in particular pressure signal generating means and pressure compensating means comprise a common measuring/sensing and driving means, thus to simultaneously or successively measure/sense and drive the pressure within pressure receiving and processing means. Therefore, the known concept that a microphone is also a speaker is employed. A common measuring/sensing and driving means may be a membrane, a piezoelement or the like. Therfore, the sensing piezoelement or membrane and the pressure compensating piezoelement or membrane may be one and the same. Its action, i. e. the measuring/sensing process and the driving/compensating process, may be realized by organizing the element as a time multiplexed receiver and transmitter.

Said inventive assembly for transducing pressure may be adapted to receive and convert sound from the environment as a pressure varying with time and/or in space, in particular, in the audible, infrasonic and/or ultrasonic range.

In particular the inventive pressure transducing assembly may be adapted to receive and convert sound from the environment in the audible range from 15 Hz to 20 kHz. This ensures a proper application when using the pressure transducing assembly as a microphone. It may also be used as a tool for testing material quality or as an intrusion or motion detector.

The inventive pressure transducing assembly may be employed to a wide range of applications. Additional to applications in gaseous media such as air or the like the inventive assembling may be applied to measuring processes in liquids or the like, therefore, acting as an microphone or pressure transducer for liquids or fluids.

One can think of underwater microphones and of sonar applications. Furthermore, the spectral range of the pressure/sound signals to be measured by the inventive assembly may be chosen in a way that medical applications, for instance as ultrasonic devices or cameras, heartbeat monitors or the like are possible.

To further adjust for the proper application the cavity assembly and in particular the respective compartments may be filled with an appropriate gas or fluid, in particular with air. The medium must have appropriate properties with respect to compressibility, which is best fulfilled by gaseous media.

To avoid acoustical interferences—as sound is equivalent to a pressure distribution changing in space and time—the inventive pressure transducing assembly may have a maximum linear dimension being smaller than half of the minimum wavelength $\lambda_{min}$, which is defined by a respective dispersion relation $$c(n,v)=\lambda(n,v).\ v$$

for $v=v_{max}$.

In this dispersion relation v denotes the frequency of the sound and has to be set to the maximum frequency $v_{max}$ of the sound spectrum to be detected. n describes the material properties. $\lambda$ describes the wavelength, and c the propagation speed of the sound within said material.

In particular, in the application range of audible sound to the maximum frequency $v_{max}$=20 kHz, the inventive pressure transducing assembly and in particular the cavity assembly should have a maximum linear dimension of the cavity assembly which is small against 0,8 cm, when the cavity assembly is filled with dry air. For other applications the frequency range can be appropriately set and in particular the maximum frequency can be set to the far ultrasonic range, thereby reducing the maximum linear dimension of the cavity assembly according to the dispersion relation described above. For example for audio DVD and SACD devices the frequency range may cover 3 Hz to 48 kHz.

To ensure proper manufacturing in such low linear dimensions the inventive assembly for transducing pressure/sound may be manufactured by means of a micro-/nano manufacturing or engineering process as a micro-/nano-structure, in particular from a polymer solution or the like.

In such a manufacturing process a model of a preferred design of the three-dimensional structure of the pressure transducing device is subdivided into parts or slices of a distinct shape and width with a sequence of the parts or slices building in succession the complete design or model.

Each section or slice may then be projected by means of an optical arrangement to a distinct location within a polymer solution, with the projecting light leading the polymer solution in the focus of the projection to polymerize and therefore to build compact or solid material with the remaining parts of the solution not being accessed by focussed light remaining fluid.

Therefore, the design of the micro-structure of the inventive pressure transducing assembly can be built up slice by slice, including in particular the distinct membranes of pressure transmitting means, pressure signal generating means and pressure compensating means.

On the other hand micro-machining may be used to manufacture the inventive pressure transducing assembly on the basis of semiconductor substrates and in particular on the basis of silicon machining where the mechanical components and the electronics are built up and incorporated on a single chip preferably made of silicon.

The process may be realized by optical and/or x-ray lithography, chemical and/or physical deposition and/or etching.

These methods have been proven to be suitable for processing semiconductor material and in particular silicon.

It is further preferred that the inventive pressure transducing assembly is manufactured as a or on a piece of a silicon (Si), germanium (Ge), gallium arsenide (GaAs) or the like, in particular co-existing with electrical circuitry and further in particular using VLSI micro-/nano-technology. In reduced linear dimensions such a single-chip implementation can be used in particular in medical applications, for example in heart catheters for measuring the mechanical heart activity.

Figure 2:
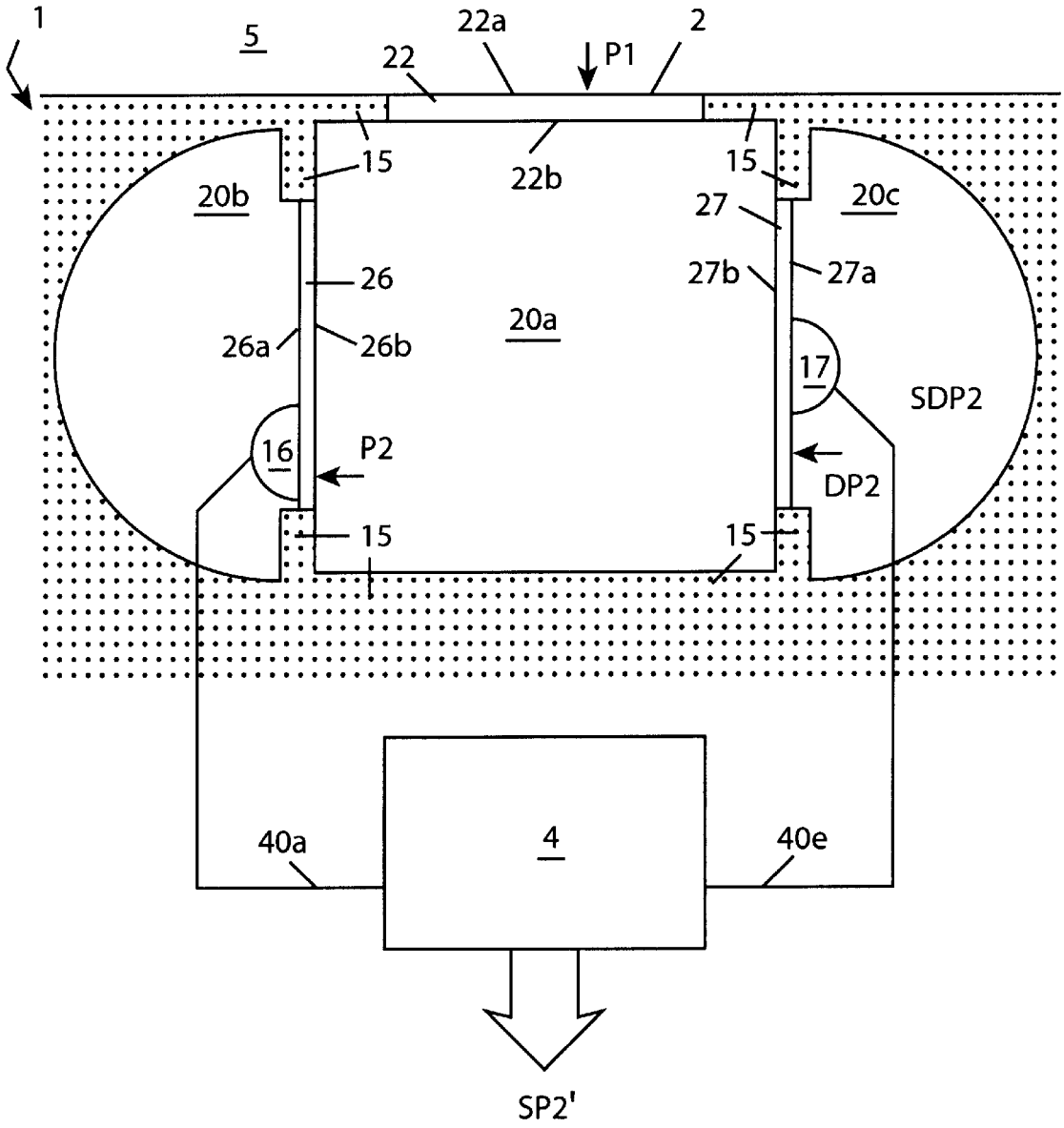
Figure 3:
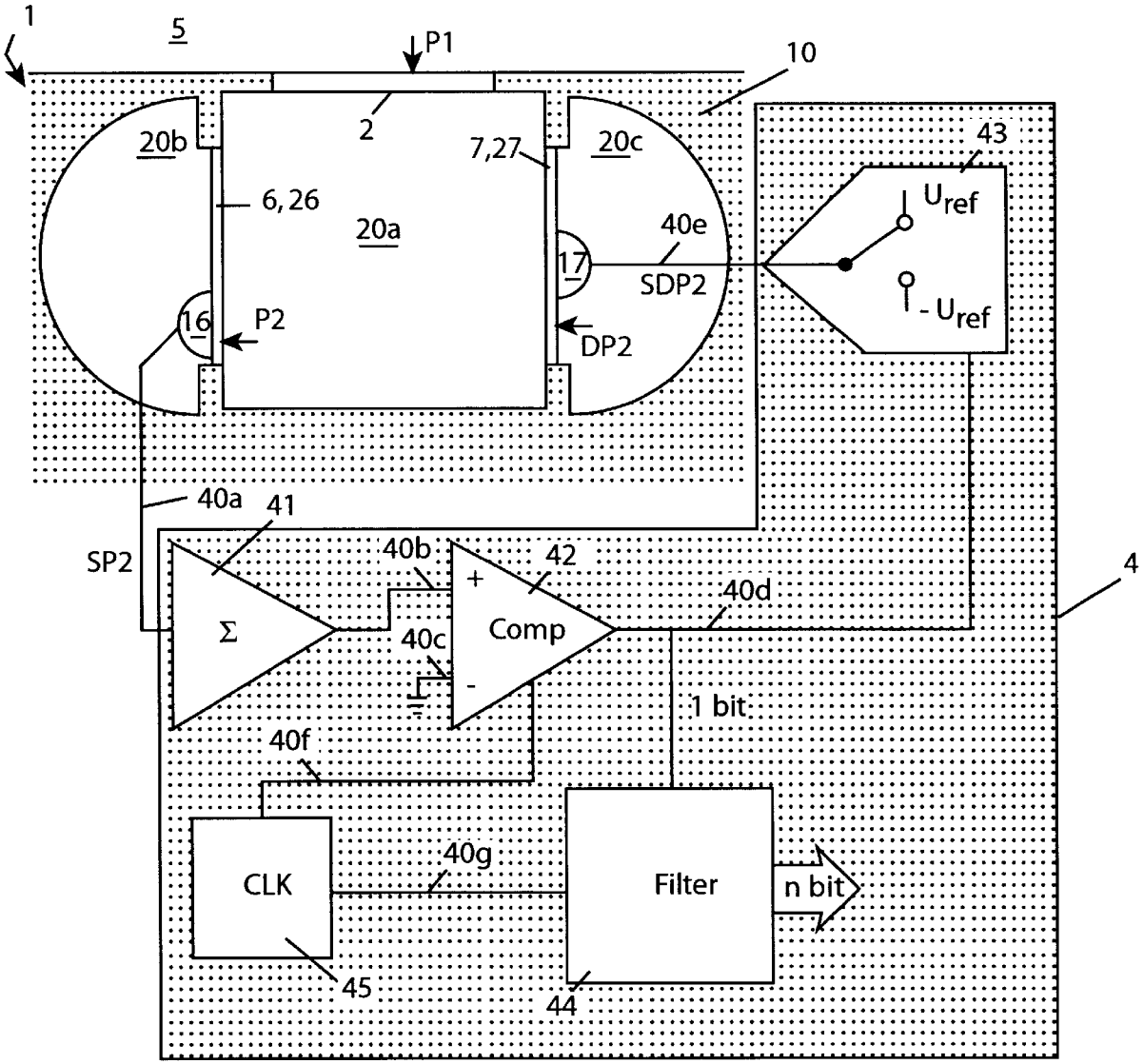
Figure 4:
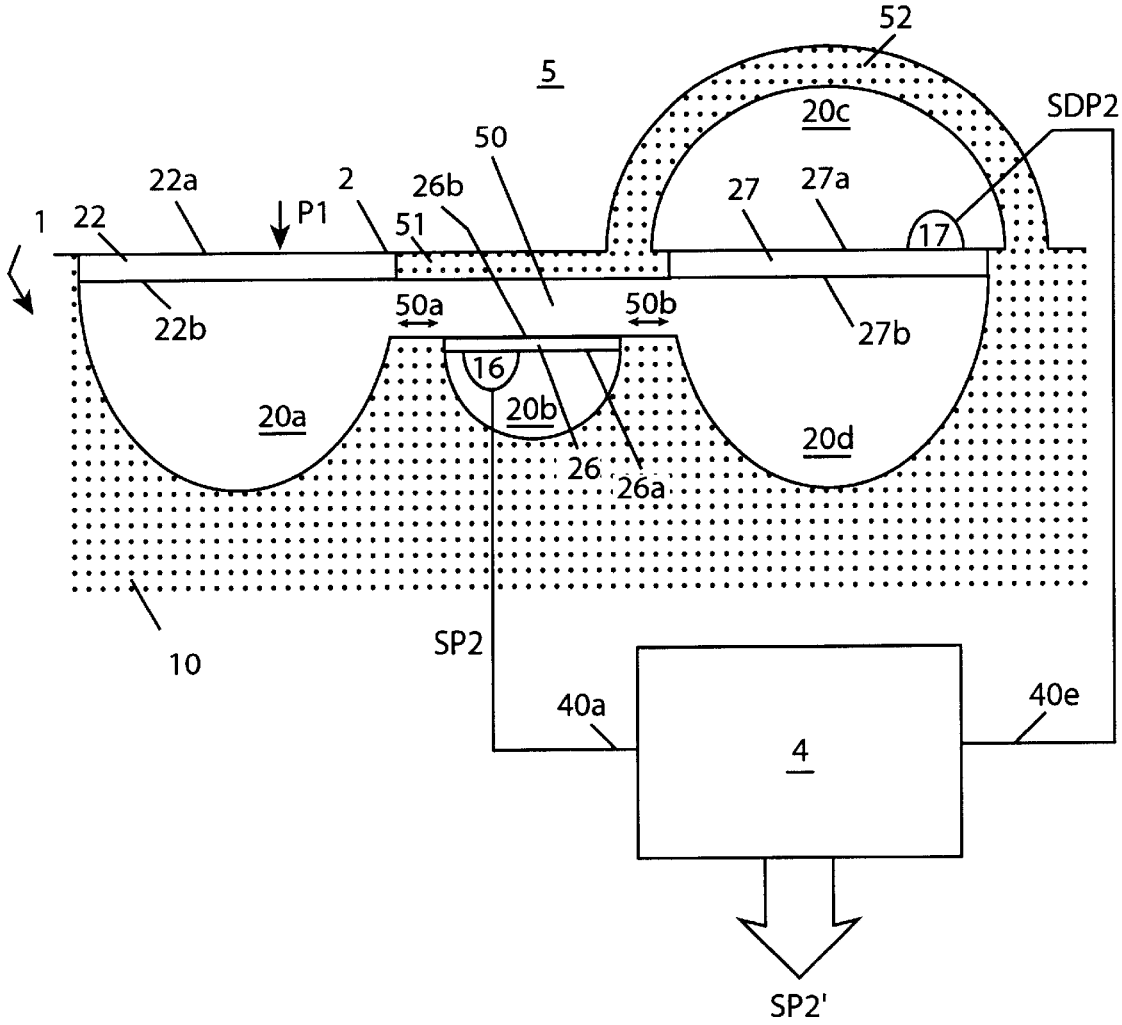
Figure 5:
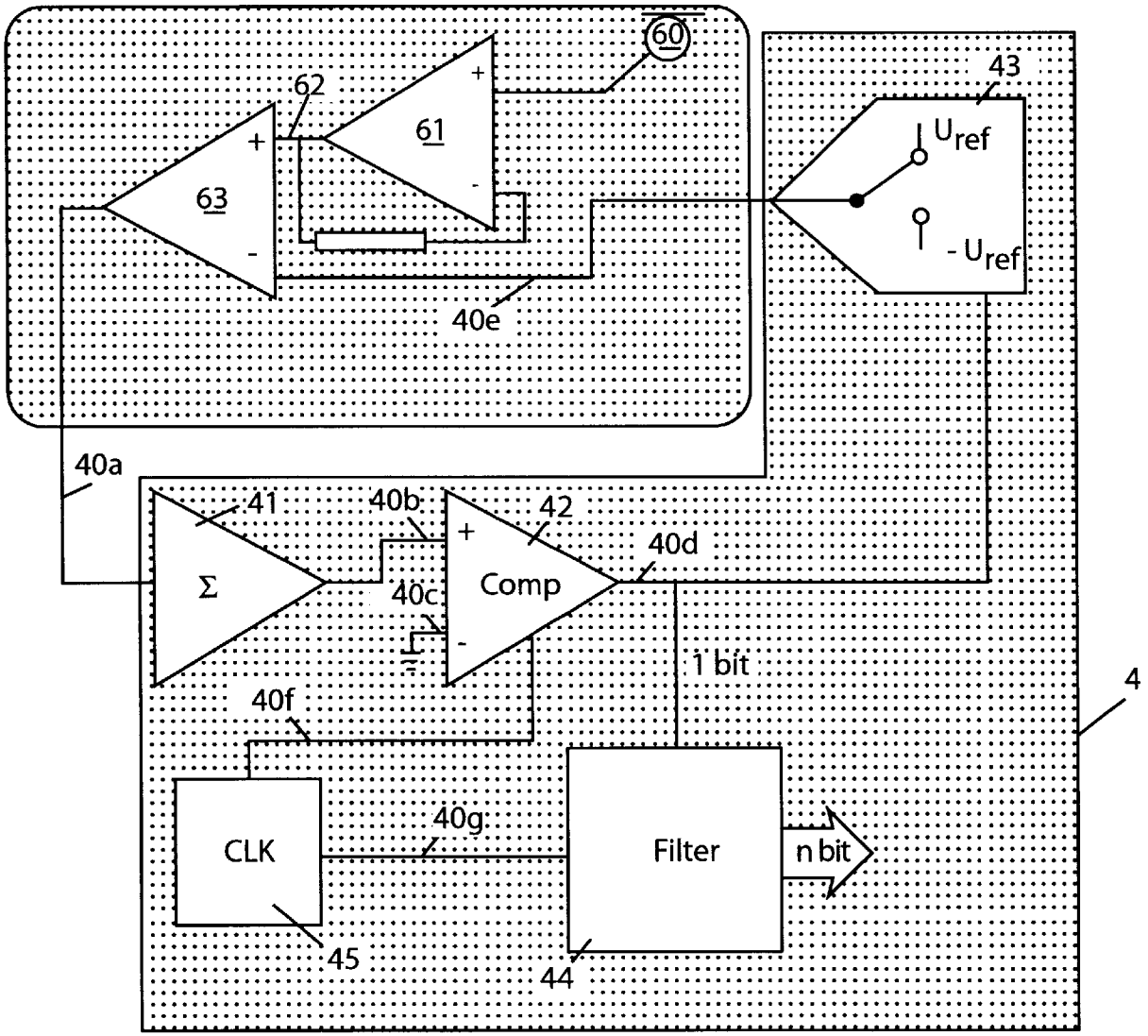
FIG. 5 (PRIOR ART)

The invention will be understood in more detail by means of the accompanying drawings, in which FIG. 1 shows a schematical block diagram illustrating the basic idea of the present invention, FIG. 2 shows a schematical and cross-sectional view of a first embodiment of the inventive pressure transducing assembly, FIG. 3 shows the embodiment of FIG. 2, in which the pressure signal processing means is displayed in more detail, FIG. 4 shows a schematical and cross-sectional view of a further embodiment of the inventive pressure transducing assembly, and FIG. 5 shows a conventional pressure transducing assembly.

FIG. 1 shows by means of a schematical and cross-sectional side view a first embodiment of the inventive pressure transducing assembly and thereby illustrates the main inventive idea.

From an environment 5 having a pressure state P1 the pressure P1 enters the pressure transducing assembly 1 due to the pressure transmitting means 2 being embedded in the housing 10 of the pressure transducing assembly 1.

Pressure transmitting means 2 interacts with the external or environmental pressure P1 of the environment 5 and therefore changes its shape and bends. In compartment 20*a* of pressure receiving and processing means 3 internal pressure P2 is generated according to medium of compartment 20*a* being compressed or expanded until equilibrium is reached at interfacing pressure transmitting means 2. P2 acts on pressure signal generating means 6 being part of said pressure receiving and processing means 3. The electrical and/or mechanical state of pressure signal generating means 6 is changed due to the interaction with the internal pressure P2. Accordingly, an analogue pressure signal SP2 is generated and transmitted to pressure signal processing means 4. The latter produces by means of its negative-feedback capabilities an analogue pressure compensating signal SDP2 which is supplied to pressure compensating means 7 incorporated in said pressure receiving and processing means 3 as to generate a compensating pressure DP2 in said compartment 20*a* of said pressure receiving and processing means 3.

Furthermore, pressure signal processing means 4 generates in accordance to the pressure value P2 to be balanced a digital pressure signal SP2' as an output signal being representative for said environmental pressure P1 or said internal pressure P2, respectively.

FIG. 2 shows by means of a schematical and cross-sectional side view a first embodiment of the pressure transducing assembly 1 according to the present invention.

In a housing 10 cavity assembly 20*a*, 20*b*, 20*c* with processing compartment 20*a*. detection compartment 20*b* and compensation compartment 20*c* is arranged.

The processing compartment 20*a* is bounded by the walls 15 of the housing 10 as well as by a membrane 22 of said pressure transmitting means 2 and by membranes 26, 27 of said pressure signal generating means 6 and said pressure compensating means 7, respectively.

The faces 22*b*, 26*b* and 27*b* are called inside faces of the respective membranes 22, 26 and 27, respectively.

The faces 22*a*, 26*a* and 27*a* are called outside faces of the respective membranes 22, 26 and 27, respectively.

Connected to the outside face 26*a* of membrane 26 of pressure signal generating means 6 sensor means 16 is connected to sense the electrical and/or mechanical state of membrane 26 due to the interaction with internal pressure P2 of processing compartment 20*a*. Sensor means 16 generates a signal being representative for said change of electrical/mechanical state. Said signal may serve as said analogue pressure signal SP2.

The outside face 27*a* of membrane 27 of said pressure compensation means 7 and probe and/or actuator means 17 are arranged so as to force said membrane 27 to change shape and/or electrical state upon impressing an analogue or digital pressure compensating signal SDP2 on said membrane 27 thereby creating additional pressure DP2 in said processing compartment 20*a* of said pressure receiving and processing means 3.

Sensor means 16 and probe/actuator means 17 are connected by lines 40*a*, 40*e* to said pressure signal processing means 4 which has electronic negative-feedback capabilities for generating said pressure compensation signal SDP2. Furthermore, pressure signal processing means 4 generates a digital output signal SP2' being representative for said external pressure P1 of the environment 5 and/or of the internal pressure P2 of the processing compartment 20*a* of the cavity assembly 20*a*, 20*b*, 20*c* of pressure receiving and processing means 3.

The embodiment of FIG. 3 is essentially identical with the embodiment of FIG. 2 with respect to the mechanical properties and the mechanical arrangement of pressure transmitting means 2, pressure receiving and processing means, the environment 5 and housing 10. But in FIG. 3 essentials of the negative-feedback loop are explained in more detail.

The input stage of pressure signal processing means 4 is built-up by a summing/integrating section or amplifier 41, its input line 40*a* being connected to said sensor means 16 of said pressure signal generating means 6. This section 41 could be a simple RC low-pass filter.

Integrator 41 is connected to the positive input of a comparator 42 by line 40*b*, the comparator 42 producing a sequence of 1's and 0's dependent on whether or not the input signal on line 40*b* is positive or negative with respect to the ground potential connected by line 40*c* to the negative input of comparator 42.

Therefore, integrator 41 and comparator 42 together work as a 1-bit analogue-to-digital converter (ADC) for the input signal of line 40*a*. The output line 40*d* of comparator 42 on the one hand connects comparator 42 to a 1-bit digital-to-analogue converter (DAC) 43 which upon the input on line 40*d* produces an output voltage $-U_{ref}$ upon each 0 and an output voltage $+U_{ref}$ for each 1, said voltage signal being supplied by line 40*e* to said probe/actuator means 17 of said pressure compensating means 7 and serving as said analogue pressure compensation signal SDP2.

On the other hand, line 40*d* connects the output of comparator 42 with a digital filter device 44 and therefore supplies the sequence of 0's and 1's to said digital filter 44, the latter producing an n-bit output signal SP2' being representative for said environmental pressure P1 or internal pressure P2, respectively.

A clock device 45 may be connected via lines 40*f* and 40*g* to said comparator means 42 and said digital filter 44, respectively, to control the digitizing and feedback processing and to define the so-called oversampling rate. The n-bit output signals SP2' are supplied with an output rate being lower than the oversampling rate of the clock device 45, but having a width of n bit instead of one bit.

FIG. 4 shows by means of a schematical and cross-sectional view a further embodiment of the inventive pressure transducing assembly 1.

A substantial part of the housing 10 of said embodiment is built-up by a so-called solid VLSI-chip in which the processing compartment 20*a* and detection compartment 20*b* and an additional compensation compartment 20*d* are formed as cavities. From above the cavity assembly 20*a*, 20*b*, 20*d* is covered by a membrane 22 of the pressure transmitting means 2 and solid cover elements 51 and 52.

Compartments 20*a*, 20*b* and 20*d* are spaced apart from each other by channel sections 50*a* and 50*b* formed by the cover element 51 and the housing 10 or VLSI-chip.

Channel sections 50*a* and 50*b* form parts of a channel 50 connecting processing compartments 20*a* and additional compensation compartment 20*d*. Between the latter compartments detection compartment 20*d* is arranged below channel 50 with the membrane 26—carried out as an electrical capacitor—forming a boundary lower element of the channel 50.

Additional cover element 52 forms the primary compensation compartment 20*c* of pressure compensation means 7 adjacent said additional compensation compartment 20*d*. Primary compensation compartment 22*c* and additional compensation compartment 20*d* are separated by means of membrane 27 of pressure compensation means 7.

The external or environmental pressure P1 is transmitted by means of membrane 22 of pressure transmitting means 2 into cavity assembly 20*a*, 20*b* , 20*c* and 20*d* of pressure receiving and processing means 3, where internal pressure P2 is formed. Connected to membrane 26 of pressure signal generating means 6 sensor means 16 is connected for detecting the change of electrical/mechanical state of membrane 26 and providing an appropriate pressure signal SP2 by line 40*a* to pressure signal processing means 4. Pressure signal SP2 may be an analogue electrical signal or already a digitized electrical equivalent.

Pressure signal processing means 4 generates a pressure compensating signal SDP2 supplied to probe/sensor means 17 being connected to membrane 27 of pressure compensating means 7. Upon receipt of pressure compensating signal SDP2 probe/actuator means 17 influences said membrane 27 to bend and to change shape as to compress/expand the medium inside the cavity assembly 20*a*, 20*b*, 20*c*, 20*d* and therefore balancing the internal pressure P2.

In the embodiment of FIG. 3 pressure compensating signal on line 40*d* is an analogue electrical signal which is fed into a 1-bit digital-to-analogue converter (DAC) 43 by line 40*d*. DAC 43 generates a sequence of voltage values $U_{ref}$ and $-U_{ref}$ for each occurrence of a 1 or 0, respectively, or vice versa. This voltage is an analogue voltage signal and drives membrane 27 of pressure compensating means 7.

To avoid the introduction of additional electrical analogue noise by employing DAC 43 it is also possible to omit the latter and to use the digital signal of line 40*d* as a driving signal SDP2 directly without digital-to-analogue conversion. According to this embodiment—not shown in FIG. 3—one can get rid of any driving means and in particular of any digital-to-analogue conversion section 43. The direct digital signal SDP2 transmits just on-and-off-signals and therefore the 1-bit analogue-to-digital conversion section 42 acts as a switch which introduces only little additional noise.

The compensating signal SDP2 consists thereof on "on" or "off" electrical signals, where the probability, i. e. the frequency of occurances, of 1's and 0's determines the analogue pressure level. Therefore, noise relates more to phase jitter of the digital driving signal rather than to voltage noise which would be introduced by an DAC 43.

Additionally, pressure signal processing means 4 provides an n-bit output signal SP2' being representative for said internal pressure P2 and said environmental pressure P1, respectively.

As mentioned above, the summing/integrating section 41 of the embodiment of FIG. 3 may be as a first order filter a simple RC-filter. It should be mentioned, that the cavity 20*a* also acts as an integrator itself. Therefore, the summing/integrating section 41 is partly realized by said cavity 20*a* in the mechanical implementation of the inventive pressure transducing assembly.

For the cavity 20*a* to act as an integrating section the displacement of membrane 27 and in particular the discrete displacements (on/off) have to be fast enough so that the cavity 20*a* responds as an integrator. This can be accomplished by having a displacement frequency—i. e. the 1-bit sample frequency in the MHz-range. The frequencies of the measured pressure or sound signal remain in the aforementioned ranges of 20 Hz to 20 kHz or 3 Hz to 48 kHz as for the new DVD- and SACD-standards.

If the displacement frequencies are high enough the cavity 20*a* will not respond to the individual displacement movements, but will rather integrate the sequence of series of the discrete displacement movements to their DC-equivalent, the DC-frequency being the signal frequency of 3 to 48 kHz and the frequency of the individual displacements being between 3 to 10 MHz. This is similar to the realization of a pure electronic delta-sigma ADC but is based on a mechanical analogue.

the main advantage is that the actual displacement or displacements can be highly non-linear, i. e. the response of the actuator or sensor membrane 26 and 27 and their sensors/actuators 16 and 17 may be non-linear. These non-linearities will be cancelled out by the error-feedback mechanism when using a 1-bit compensation signal SDP2.

The non-linearity of the actuator membrane 27 does not cause any difficulties because the membrane has only two positional states: on (displaced) or off (idle). The displacement of the membrane has to be accurate—i. e. identical—from cycle to cycle. This is the reason for the advantages of the digital 1-bit error signal STD2 over an analogue displacement movement.

The non-linearity of the sensor membrane 26 does not cause any difficulties too, because the system always compensates the internal pressure of the cavity 20*a* to an equilibrium value, i. e. in the time average membrane 26 is in a non-displaced or idle state. Any displacement of the sensor membrane 26 contributes to or constitutes an error signal SP2 on line 40*a* which will be compensated to an equilibrium pressure value in cavity 20*a* by the pressure compensation signal SDP2. Thus, the system processes in inherent high linear behavior in particular independent of the possible non-linearities of the constituting components.

The main parts that determine the system accuracy are the clock frequency jitter because this jitter constitutes an FM-modulation of the spectrum of the input signal. The relative precision of the comparator 42 and the realized D/A-switch also need to have a low-noise voltage reference to generate the pressure compensating signal SDP2. The comparator 42 can be made highly accurate by using switched-capacitor circuitry that self-calibrates from cycle to cycle. Therefore, a DC-offset does not matter, the comparator performance remains constant from cycle to cycle and the mechanical implementation with its various mechanical parts can have wide manufacturing tolerances. The main advantage—i. e. the high inherent linearity of direct delta-sigma ADC's and DAC's remains unchanged.

A further basic idea is that pressure inside the closed cavity assembly and in particular in the cavity 20*a* is always put to an equilibrium pressure. Membrane 26 therefore almost rests at a zero mechanical deflection, at least in time average, as any deflection of membrane 26 is converted to an "error signal" SP2 on line 40*a*. Said error signal SP2 on line 40*a* is fed back digitally or in an analogue way as a negative compensation signal SDP2 on line 40*e* or 40*d* to membrane 27 of pressure orcompensating means 7. Line 40*a* carries the actual "error signal" SP2 and line 40*b* after the summing/integrating section 41 carries the average "error signal".

The design of the embodiment of FIG. 4 has the advantage that its cavities 20*a*, 20*b* and 20*d* can be manufactured by a lithographic or an etching process which are known to be suitable for producing integrated circuit chips. After forming the cavities 20*a*, 20*b* and 20*d* the distinct membranes 22, 26 and 27 and the additional cover elements 51 and 52 have to be fixed to complete the inventive pressure transducing assembly 1 and to isolate the cavity assembly 20*a*, 20*b*, 20*d* and 20*c* against each other and the environment 5.

FIG. 5 shows by means of a schematical representation a conventional pressure transducing assembly using a conventional built-up delta-sigma digital transducer.

In contrast to the present invention the input stage of a conventional pressure transducing assembly is an analogue microphone 60 followed by an analogue amplifier section 61. The output signal of the latter is supplied by line 62 to the positive input of an adding/summation section 63. The output of the adding/summation section 63 is connected by line 40*a* to an integrator 41 followed by a comparator 42 which provides on line 40*d* a digital output signal to a digital-to-analogue converter 43 which closes a feedback loop by supplying an analogue signal to the negative input of said adding/summation section 63.

Additionally, connected to line 40*d* of comparator 42 is a digital filter section 44 producing an n-bit output signal SP2' being representative to said pressure signal received by the microphone section 60 but having—in contrast to the present invention utilizing a delta-sigma direct pressure transducer—additional analogue electronic noise from the amplifier section 61 and from the adding/summation section 63.

What is claimed is:

1. Pressure transducing assembly for converting received pressure into a digital pressure signal, comprising pressure transmitting means (2), pressure receiving and processing means (3), and pressure signal processing means (4), wherein a) said pressure transmitting means (2) is adapted to receive a first or environmental mechanical pressure (P1) from an environment (5) and to transmit said first pressure (P1) to said pressure receiving and processing means (3), b) said pressure receiving and processing means (3) is adapted to generate a second or internal mechanical pressure (P2) therein in accordance with said received first pressure (P1) and to process said second pressure (P2), c) said pressure receiving and processing means (3) comprises pressure signal generating means (6) being adapted for generating a first or analogue pressure signal (SP2) being representative for said second pressure (P2), d) said pressure receiving and processing means (3) comprises pressure compensating means (7) being adapted for receiving a pressure compensation signal (SDP2) and for generating additional pressure (DP2) within said pressure receiving and processing means (3) so as to compensate said second pressure (P2) at least partially, e) said pressure signal processing means (4) is adapted to receive and process said first analogue pressure signal (SP2), f) said pressure signal processing means (4) has negative-feedback capabilities to generate said analogue pressure compensating signal (SDP2) at least based on said received analogue pressure signal (SP2), and g) said pressure signal processing means (4) is adapted to generate a digital pressure signal (SP2') having an integer number of bits and being representative at least for said internal pressure (P2) and to provide at least said digital pressure signal (SP2') as an output signal.

2. Assembly according to claim 1, including housing means (10) and wherein at least said pressure transmitting means (2) and said pressure receiving and processing means (3) are essentially embedded into said housing means (10).

3. Assembly according to claim 2, wherein said housing means (10) is mechanical rigid and/or impermeable to material exchange.

4. Assembly according to claim 1, wherein said pressure means (2) has a section (2*a*) being exposed to the environment and/or to the first pressure (P1) and said pressure transmitting means (2) further has a second section (2*b*) being exposed to said pressure receiving and processing means (e).

5. Assembly according to claim 1, wherein said pressure transmitting means (2) and/or said housing means (10) is adapted and arranged so as to essentially isolate said pressure receiving and processing means (3) from being affected by pressure and/or material flow from the environment (5) directly.

6. Assembly according to claim 1, wherein said pressure transmitting means (2) is essentially impermeable to material exchange.

7. Assembly according to claim 1, wherein said pressure transmitting means (2) has at least a first membrane element (22) with an environmental side face (22*a*) being exposed to the environment (5) and an inside face (22*b*) being exposed to said pressure receiving and processing means (3) and said membrane element (22) is arranged in said housing means (10) so as to separate said pressure receiving and processing means (3) from direct pressure and/or material flow from said environment (5).

8. Assembly according to claim 1, wherein said pressure receiving and processing means (3) has a cavity assembly (20*a*, 20*b*, 20*c*) is arranged in said housing means (10) and has said pressure transmitting means (2) at least as a part of a boundary against the environment (5).

9. Assembly according to claim 8, wherein said pressure signal generating means (6) comprises at least a first separating element (26), said first separating element (26) is arranged as to form an isolating detection compartment (20*b*) within said cavity assembly (20*a*, 20*b*, 20*c*), and said detection compartment (20*b*) is isolated from said environment (5) as well as from said pressure transmitting means (2) and has an outside face (26*b*) being exposed to a remaining compartment (20*a*) of said cavity assembly (20*a*, 20*b*, 20*c*) containing said pressure transmitting means (2) as a part of its boundary and an opposed inside face (26*a*) being exposed to the inside of the detection compartment (20*b*).

10. Assembly according to claim 9, wherein said first and/or second separating element (26, 27) comprises mechanical flexible membranes (26, 27).

11. Assembly according to claim 10, wherein said first and/or second membrane (26, 27) has at least in part an electrical conductive surface.

12. Assembly according to claim 10, wherein said first and/or second membrane (26, 27) contains at least in part electrostrictive and/or piezoactive material.

13. Assembly according to claim 8, wherein said pressure compensating means (7) comprises at least a second separating element (27), said second separating element (27) forms an isolated compensation compartment (20*c*) within said cavity assembly (20*a*, 20*b*, 20*c*), and said compensation compartment (20*c*) is isolated from said environment (5) as well as from said pressure transmitting means (2) and has an outside face (27*b*) being exposed to said remaining compartment (20*a*) of said cavity assembly (20*a*, 20*b*, 20*c*) containing said pressure transmitting means (2) as a part of its boundary and having an opposed inside face (27*a*) being exposed to the inside of the compensation compartment (20*c*).

14. Assembly according to claim 1, wherein said pressure signal generating means (6) comprises sensor means (16) being adapted to sense the electrical and/or mechanical state of the first separating element (26) and in particular of the first membrane (26) and to provide said analogue pressure signal (SP2).

15. Assembly according to claim 1, wherein said pressure compensating means (7) comprises probe and/or actuator means (17) being adapted to change the electrical and/or mechanical state of the second separating element (27) and in particular of the second membrane (27) according to said analogue pressure compensation signal (SDP2) as to force said separating element/membrane (27) to superpose said additional pressure (DP2) at least to the remaining compartment (20*a*) of said cavity assembly (20*a*, 20*b*, 20*c*).

16. Assembly according to claim 1, wherein the assembly is adapted to receive and convert sound from the environment (5) as pressure varying in time, in particular in the audible and/or ultrasonic range.

17. Assembly according to claim 1, adapted to receive and convert sound from the environment (5) in the range of 15 Hz to 20 kHz.

18. Assembly according to claim 1, further including a cavity assembly (20*a*, 20*b*, 20*c*) being filled with a gas or fluid.

19. Assembly according to claim 18, wherein a maximum linear dimension of the cavity assembly (20*a*, 20*b*, 20*c*) is small against half of the minimum wavelength ($\lambda$min), the latter being defined by the dispersion relation $$c(n,v)=\lambda(n,v).v$$

for $v=v_{max}$, wherein v is the frequency of the pressure/sound to be received and converted, $\lambda$ denotes the material and frequency dependent wavelength, $v_{max}$ is the maximum frequency to be detected, n denotes the material properties of the medium the cavity assembly (20*a*, 20*b*, 20*c*) is filled with, c is the speed of propagation of pressure/sound within said medium.

20. Assembly according to claim 18, wherein a maximum linear dimension of the cavity assembly (20*a*, 20*b*, 20*c*) is small against the length 0.8 cm, corresponding to a maximum frequency $v_{max}$=20 kHz in air.

21. Assembly according to claim 1, manufactured by means of micro- or nano-machinery or engineering as a micro- or nano-structure, from a polymer solution.

22. Assembly according to claim 1, manufactured as a or on a piece of silicon (Si), germanium (Ge), gallium arsenide (GaAs), co-existing with electrical circuitry, using VLSI micro-/nano-technology.

* * * * *